US007920157B2

(12) United States Patent
Nakase

(10) Patent No.: US 7,920,157 B2
(45) Date of Patent: Apr. 5, 2011

(54) IMAGE FORMING APPARATUS THAT CONTROLS AN EXPOSURE AMOUNT INTENSITY FOR FORMING A FIRST IMAGE FORMED OF AN EQUAL OR SMALLER NUMBER OF CONSECUTIVE DOTS THAN A PREDETERMINED NUMBER IN A PREDETERMINED DIRECTION IS HIGHER THAN AN ELECTRIC INTENSITY FOR FORMING A SECOND

(75) Inventor: Takahiro Nakase, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 12/331,314

(22) Filed: Dec. 9, 2008

(65) Prior Publication Data

US 2009/0154946 A1 Jun. 18, 2009

(30) Foreign Application Priority Data

Dec. 12, 2007 (JP) ..... 2007-321372

(51) Int. Cl.
*B41J 2/47* (2006.01)

(52) U.S. Cl. ..... 347/253

(58) Field of Classification Search ..... 347/240, 347/251–254

See application file for complete search history.

(56) References Cited

U.S. PATENT DOCUMENTS

| | | | | |
|---|---|---|---|---|
| 4,905,023 | A | 2/1990 | Suzuki | |
| 6,285,385 | B1 | 9/2001 | Owaki | |
| 6,538,678 | B2 | 3/2003 | Nakase | |
| 6,686,943 | B2 * | 2/2004 | Ishii et al. | 347/133 |
| 6,876,494 | B2 * | 4/2005 | Ishikawa et al. | 359/618 |
| 6,987,589 | B2 * | 1/2006 | Murakami | 358/3.27 |

FOREIGN PATENT DOCUMENTS

| | | | |
|---|---|---|---|
| JP | 63-124667 | A | 5/1988 |
| JP | 05-107885 | A | 4/1993 |
| JP | 2000-194179 | A | 7/2000 |
| JP | 2000-267362 | A | 9/2000 |
| JP | 2002-023435 | A | 1/2002 |
| JP | 2002-258587 | A | 9/2002 |
| JP | 2002-292929 | A | 10/2002 |

* cited by examiner

*Primary Examiner* — Hai C Pham

(74) *Attorney, Agent, or Firm* — Canon U.S.A., Inc. I.P. Division

(57) ABSTRACT

In an image forming apparatus, an exposure device performs exposure on a non-image area of image pattern, performs an exposure on the image area in an exposure amount lower than the non-image area or does not perform exposure, and an exposure amount control device controls, with respect to pixels having the same density data, an exposure amount given by an exposure device to be smaller in a first portion, which is a thin-line of a width that is equal to or less than a predetermined number of pixels or which is an isolated dot of widths that are equal to or less than the predetermined number of pixels in two directions substantially orthogonal to each other, than in a second portion which is a line of a width exceeding the predetermined number or a surface of widths that exceed the predetermined number in two directions substantially orthogonal to each other.

4 Claims, 8 Drawing Sheets

IMAGE FORMING APPARATUS THAT CONTROLS AN EXPOSURE AMOUNT INTENSITY FOR FORMING A FIRST IMAGE FORMED OF AN EQUAL OR SMALLER NUMBER OF CONSECUTIVE DOTS THAN A PREDETERMINED NUMBER IN A PREDETERMINED DIRECTION IS HIGHER THAN AN ELECTRIC INTENSITY FOR FORMING A SECOND

BACKGROUND OF THE INVENTION

1. Field of the Invention

The present invention relates to an image forming apparatus of an electrophotographic method that forms an electrostatic latent image by scanning a photosensitive drum with a laser beam and that causes a toner to adhere thereto to record an image on a recording medium.

2. Description of the Related Art

Conventionally, an image forming apparatus operating by an electrophotographic method has been widely used, by which an electrostatic latent image (electrostatic image) is formed on a photosensitive member by exposing to light an electrophotographic photosensitive member that is a charged image bearing member, according to image information, and then an image is formed by developing the electrostatic latent image with a developer.

In addition, as discussed in Japanese Patent Application Laid-Open No. 2002-23435, there is a back area exposure method, which exposes to light a non-image area (bright image area) where a developer is not applied, in an image forming apparatus of an electrophotographic method. The back area exposure method is a method in which little unevenness appears in an image area (dark image area) where the developer is applied, and fogging (phenomenon in which the developer is deposited on the non-image area) and change in density occur infrequently.

As to a toner used as a developer in the electrophotographic method, a negative toner, in which the normal charging polarity is negative, is currently mainstream from viewpoint of the stability of material. When using the negative toner, the back area exposure method is also effective against defocusing of image that occurs due to a dull electrostatic latent image. The defocusing of image due to the dull latent image occurs when NOx is deposited on the surface of the photosensitive member, and a surface electrical resistance of the photosensitive member decreases. NOx is formed when ozone produced in charging a photosensitive member combines with nitrogen in air.

When the back area exposure is performed using the negative toner, the charging polarity of the photosensitive member is a positive polarity. The amount of ozone produced when the photosensitive member is charged with a positive polarity is approximately one-fifth of that produced when the photosensitive member is charged with a negative polarity. Therefore, in the back area exposure method, the surface resistance of the photosensitive member decreases much less than in an image area exposure method which exposes the image area where the developer is applied.

Additionally, as discussed in Japanese Patent Application Laid-Open No. 2002-258587, the back area exposure method is also effective against streaks when an amorphous silicon photosensitive member having a long lifetime is used. Such streaks may appear if the charging polarity of the photosensitive member and the charging polarity of the toner to be used are the same. Accordingly, in the back area exposure method, such streaks typically do not appear.

In recent years, image forming apparatuses for printers, copying machines, facsimiles, etc. have made remarkable progress in high resolution. Here, as an example, a case is considered where a resolution is increased from 600 dots per inch (dpi) to 1200 dpi.

In this case, a size of one pixel is halved from 42 μm to 21 μm. However, the spot diameter of an exposure device for forming a latent image of an image pattern on a charged photosensitive member is currently approximately 60 μm. Therefore, even if an image signal is varied for every 21 μm, the spot diameter remains at 60 μm. Accordingly, it is hard to reproduce an image pattern of, for example, a thin-line such as the one consisting of 2 pixels or isolated dots (hereinafter referred to as "thin-line portion").

As illustrated in FIG. 7, in a thin-line portion, a formed latent image is shallower in depth compared to an image pattern showing, for example, a plurality of consecutive pixels (hereinafter referred as "solid portion"). Accordingly, electric field strength in a development unit becomes different between the thin-line portion and the solid portion, and the amount of applied toner becomes smaller in the thin-line portion. Therefore, reproducibility in the thin-line portion may be inferior to that in the solid portion. Such a phenomenon that a latent image becomes shallow is more remarkable in a back area exposure method than in an image area exposure method. In the back area exposure method, "a latent image becomes shallow" means that the electric potential (absolute value) of an image area becomes lower.

In order to address this problem, narrowing the spot diameter of an exposure device is considered. However, when the spot is optically narrowed, a ratio of change of a spot diameter increases against change of focal distance. As a consequence, an adjustment range of focal point becomes limited which makes the adjustment difficult. In addition, there arises a problem that the size of dots to be formed changes only by a slight vibration. While there are a mechanism to automatically correct focal points, and a method for shortening exposure wavelength, they cause the apparatus cost to increase.

Furthermore, there is a method for setting the charging potential of the photosensitive member at a high level, which emphasizes the reproducibility of the thin-line portion. However, in this case, the amount of applied toner in the solid portion increases more than necessary, and problems such as increase in consumption of the toner and flying of the toner are more likely to arise.

SUMMARY OF THE INVENTION

The present invention is directed to an image forming apparatus, using a back area exposure method, that can enhance the reproducibility of a thin-line portion with a relatively inexpensive configuration while suppressing the consumption of toner.

According to an aspect of the present invention, an image forming apparatus includes an image bearing member whose surface is movable, a charging unit configured to charge the image bearing member, an exposure unit configured to form an electrostatic latent image of an image pattern on the image bearing member by exposing the image bearing member that has been charged, an exposure amount control unit configured to control an exposure amount given by the exposure unit according to the image pattern, and a development unit configured to develop the electrostatic latent image of the image pattern with a charged developer, wherein the exposure unit performs an exposure on a non-image area of the image pattern, and performs an exposure on an image area of the image pattern in a lower exposure amount than on the non-image area or does not perform an exposure, and wherein the exposure amount control unit controls, with respect to pixels having the same density data, the exposure amount given by the exposure unit to be smaller in a first portion, which is a thin-line of a width that is equal to or less than a predetermined number of pixels or which is an isolated dot of widths that are equal to or less than the equivalent of the predetermined number of pixels in two directions substantially orthogonal to each other, than in a second portion which is a line of a width exceeding the predetermined number of pixels or a surface of widths that exceed the predetermined number of pixels in two directions substantially orthogonal to each other.

According to the present invention, in the back area exposure, the reproducibility of a thin-line portion can be enhanced inexpensively while suppressing the consumption of toner.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First, general configuration of an image forming apparatus according to a first exemplary embodiment of the present invention will be described.

Figure 1:
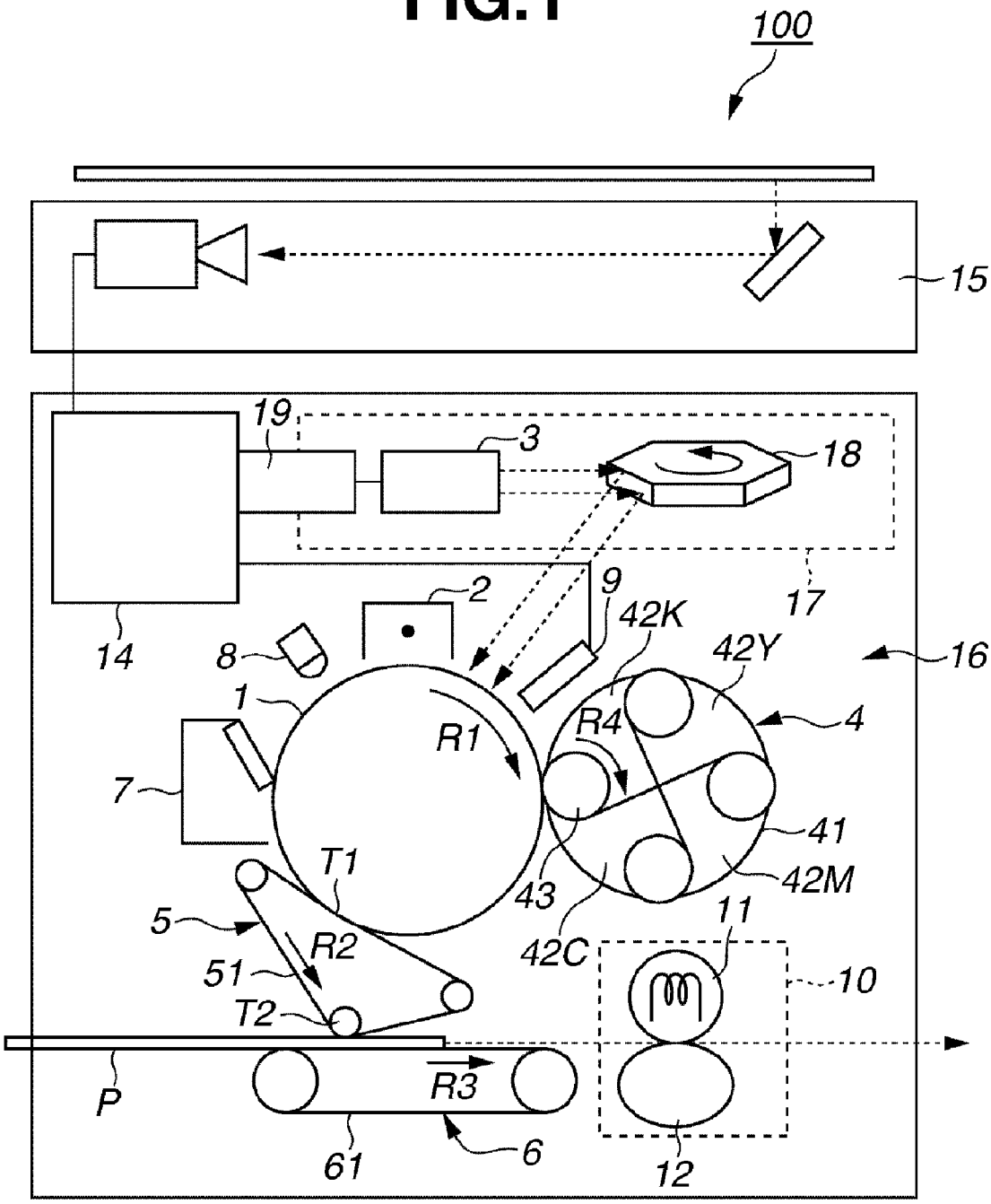
FIG. 1 is a configuration view of an image forming apparatus according to an exemplary embodiment of the present invention.

FIG. 1 is a longitudinal sectional view illustrating schematically the configuration of the main part of an image forming apparatus 100 according to the first exemplary embodiment of the present invention. The image forming apparatus 100 according to the present exemplary embodiment is a color laser copying machine using electrophotographic method. The image forming apparatus 100 can form full-color images according to image information read out by a document reading device (reader scanner) 15 mounted on an image forming apparatus main body 16. Further, the image forming apparatus 100 according to the present exemplary embodiment is capable of forming full-color images according to image information from external equipment including a personal computer connected to communicate with the image forming apparatus main body 16.

The image forming apparatus 100 includes a drum type electrophotographic photosensitive member (hereinafter referred to as "photosensitive drum") as an image bearing member. The surface of the electrophotographic photosensitive member is movable. The photosensitive drum 1 is supported rotatably in the direction of the arrow R1 (clockwise) illustrated in FIG. 1 by the image forming apparatus main body 16.

Around the photosensitive drum 1, a charging device 2, an exposure device 17, an electric potential sensor 9 and a development device 4 are arranged in order along its rotating direction. Further, around the photosensitive drum 1, an internal transfer unit 5, a cleaning device 7 and a pre-exposure device 8 are arranged in order along its rotating direction. Furthermore, an external transfer unit 6 is disposed opposing the internal transfer unit 5, and a fixing device 10 is disposed on a downstream side of the external transfer unit 6 in a direction of conveyance of a recording medium P (paper for example).

The internal transfer unit 5 has an intermediate transfer belt 51 serving as an intermediate transfer member that revolves (revolving travel) in a direction of the arrow R2 (counterclockwise) illustrated in FIG. 1. The intermediate transfer belt 51 forms a primary transfer portion (primary transfer nip) T1 in contact with the photosensitive drum 1. The external transfer unit 6 has a conveying belt (external transfer belt) 61 serving as a recording medium conveying means that revolves in the direction of the arrow R3 (clockwise) illustrated in the drawing. The conveying belt 61 forms a secondary transfer portion (secondary transfer nip) T2 in contact with the intermediate transfer belt 51. A fixing device 10 includes a fixing roller 11 incorporating a heating unit, and a pressing belt 12 that is in pressure contact with a fixing roller 11.

In the present exemplary embodiment, a development device 4 is of a rotary development type. More specifically, the development device 4 has a rotating body (rotary) 41 as a development unit support. The development device 4 is rotatably supported by the image forming apparatus main body 16. Then, first, second, third and fourth development units 42Y, 42M, 42C and 42K using yellow, magenta, cyan and black developers respectively, are attached to the rotating body 41. The development device 4 positions desired development units 42Y, 42M, 42C and 42K in a development unit opposing the photosensitive drum 1 by rotating the rotating body 41 when necessary, so that the development device 4 can perform a developing operation. In the present exemplary embodiment, configurations and operations of respective development units 42Y, 42M, 42C and 42K are substantially the same except that the colors of developers used are different from one another. Accordingly, hereinafter, the suffixes Y, M, C and K of reference numerals that represent the colors of development devices are omitted, and general description will be made unless their distinction is required.

During the image formation, the photosensitive drum 1 is driven by a driving unit (not shown) to rotate at a predetermined process speed (circumferential speed) in the direction of the arrow R1 in the drawing. The surface of the photosensitive drum 1 is uniformly (evenly) charged at a predetermined polarity/electric potential in a predetermined polarity by a charging device 2. In the present exemplary embodiment, the surface of the photosensitive drum 1 is charged in a positive polarity. A predetermined charging voltage is applied to the charging device 2 from a charging bias source (not shown) serving as a charging bias applying unit.

Then, a laser chip (light source) 3 emits light in an exposure amount indicated from an exposure amount control device 19 according to an image signal sent from an image forming controller 14. The light is directed to the surface of the charged photosensitive drum 1 by a rotating polygonal mirror 18, and the surface of the photosensitive drum 1 is irradiated with scanning light. The laser chip 3 and the polygonal mirror 18 are provided within the exposure device 17 that is a laser scanner in the present exemplary embodiment. Then, the electric charge of irradiated portion on the photosensitive drum 1 is removed and an electrostatic latent image of image pattern according to an image signal is formed on the photosensitive drum 1. In the present exemplary embodiment, a direction substantially orthogonal to a traveling direction of the surface of the photosensitive drum 1 is a main scanning direction of scanning exposure performed by the exposure device 17. A traveling direction of the surface of the photosensitive drum 1 is a sub-scanning direction of scanning exposure performed by the exposure device 17.

Next, a developing sleeve 43 rotates in the direction of the arrow R4 (clockwise) illustrated in the drawing. The developing sleeve 43 serving as a developer bearing member is provided within the development unit 42 in the development device 4. As a result of the rotation of the developing sleeve 43, a toner that is a developer charged in a predetermined polarity is deposited on an electrostatic latent image formed on the photosensitive drum 1. Thus, the electrostatic latent image is developed as a toner image. The development unit 42 can use two-component developer which is made, for example, by blending mainly nonmagnetic toner particles (toners) with magnetic carrier particles (carriers).

In the present exemplary embodiment, a negative toner is used in which a normal charging polarity is negative. Further, at least during a developing operation, a predetermined developing bias is applied to the developing sleeve 43 from a developing bias source (not shown) serving as a developing bias applying unit. In the present exemplary embodiment, an alternating voltage in which a DC voltage component is superimposed on an AC voltage component is applied as a developing bias.

Thus, a potential difference (development contrast Vcont) is formed (in a direction that a charged toner is directed from the developing sleeve 43 toward the photosensitive drum 1) between a potential of an image area (image dark area) of electrostatic latent image on the photosensitive drum 1 and an DC component potential of the developing bias. Additionally, a potential difference (Vback which removes fogging (fogging eliminates contrast)) is formed (in a direction that a charged toner is directed from the photosensitive drum 1 toward the developing sleeve 43) between a potential in a non-image area (image bright area) of an electrostatic image and a DC component potential of the developing bias.

As described below in more detail, in the present exemplary embodiment, an electrostatic latent image formed by the back area method is developed by a regular development method. More specifically, in the present exemplary embodiment, generally, a non-image area (image bright area) is exposed, and a toner charged in a polarity opposite to the charging polarity of the photosensitive member is deposited on an image area (image dark area). The image area is exposed to a smaller exposure amount of light than the non-image area (image bright area), or the image area is not exposed.

A toner image formed on the photosensitive drum 1 is electrostatically transferred (primary transfer) onto an intermediate transfer belt 51 in a primary transfer portion T1. For example, during the formation of a full-color image, toner images in respective yellow, magenta, cyan and black colors which are formed in order on the photosensitive drum 1 in the steps as described above are superimposed and transferred onto the intermediate transfer belt 51. The intermediate transfer belt 51 repeatedly passes through the primary transfer portion T1. The toner images transferred onto the intermediate transfer belt 51 are collectively transferred (secondary transfer) in a secondary transfer portion T2 onto the recording medium P that is conveyed to the secondary transfer portion T2 by a conveying belt 61.

The recording medium P onto which the toner image has been transferred is conveyed to a fixing device 10 by the conveying belt 61. The fixing device 10 fixes not-yet-fixed toner images on the recording medium P by applying heat and pressure thereto while the recording medium P is conveyed through the fixing device 10. Subsequently, the recording medium P is discharged to the outside of the image forming apparatus main body 16.

After a toner image is transferred onto the intermediate transfer belt 51, adherents such as the toner remaining on the surface of the photosensitive drum 1 are removed/recovered (recycled) by a cleaning device 7. Subsequently, the surface of the photosensitive drum 1 is discharged by a pre-exposure device 8, and put to use in subsequent image formation. Further, adherents such as the toner remaining on the surface of the intermediate transfer belt 51 after the toner image is transferred onto the recording medium P are removed/recovered by a belt cleaner (not shown). Alternatively, the adherents on the intermediate transfer belt 51 are removed/recovered by the cleaning device 7 after the adherents are reversely transferred onto the photosensitive drum 1.

The image forming apparatus 100 is capable of forming not only full-color images, but also, for example, monochrome black images. For example, when a monochrome black image is formed, the black toner image transferred onto the intermediate transfer belt 51 from the photosensitive drum 1 in the primary transfer potion T1 is transferred onto the recording medium P in the secondary transfer portion T2 without the recording medium P being conveyed again to the primary transfer portion T1.

In the present exemplary embodiment, the image forming apparatus 100 includes an exposure device 17 configured to expose a charged photosensitive drum 1 to an image pattern, an exposure amount control device 19 configured to control an exposure amount depending on the image pattern, and a development device 4 configured to develop an electrostatic latent image of the image pattern with a charged developer.

The image forming apparatus 100 forms an electrostatic latent image by the back area exposure method, causes the exposure device 17 to perform exposure on a non-image area (image bright area), and causes the exposure device 17 to perform exposure of an image area (image dark area) in a lower exposure amount than the aforementioned non-image area (image bright area) or perform no exposure of the image area.

The exposure amount control device 19 discriminates an image pattern from pixels surrounding a focused pixel, pixels continuous from the focused pixel, or from the both pixels with respect to pixels having the same density data. Then, the exposure amount control device 19 controls the exposure amount of the image area exposed by the exposure device 17, at least with respect to an image pattern portion (thin-line portion) that has been discriminated as a thin-line or isolated dot consisting of one pixel, to be lower than an image pattern portion (solid portion) where a plurality of consecutive pixels are located.

More specifically, in the present exemplary embodiment, as to pixels having the same density data, if a thin-line on the photosensitive drum 1 has a width which corresponds to less than or equal to the predetermined number of pixels, or if an isolated dot has widths in two directions substantially orthogonal to each other which respectively correspond to less than or equal to the predetermined number of pixels, the exposure amount control device 19 determines the thin-line or the isolated dot to be a first portion (thin-line portion).

Further, if a line on the photosensitive drum 1 has a width which exceeds a value corresponding to the predetermined number of pixels, or if a surface has the widths in two directions substantially orthogonal to each other which respectively exceed values corresponding to the predetermined number of pixels, the exposure amount control device 19 determines the line or the surface to be a second portion (solid portion).

Then, the amount exposed by the exposure device 17 in the first portion is made smaller than that in the second portion. In other words, the amount exposed by the exposure device 17 in the second portion is made larger than that in the first portion.

Here, "pixels having the same density data" are in an image area, in the case where the densities of respective pixels are distinguished by binary values of image area and non-image area. The present exemplary embodiment is included in this case. Further, in the case where there is a distinction of density gradation among pixels in the image area, "pixels having the same density data" may also be in the image area in which the data that represents density gradation is the same.

The exposure amount control device 19 can be implemented by a microprocessor which is provided with a computing unit, a control unit, and a storage unit. The exposure amount control device 19 may be provided within the exposure device 17, or it may be separately provided within the image forming apparatus main body 16. Further, the exposure amount control device 19 may be integrated into an image forming controller 14 that has control over the operation of the image forming apparatus 100. The exposure amount control device 19 executes the processing as described above, or as described in detail below, according to a program or data stored in a storage unit that is built-in in the device 19 or communicably connected thereto.

According to an aspect of the present invention, if the number of consecutive pixels having the same density data, in at least one of the main scanning direction and the sub-scanning direction of the exposure device 17 on the photosensitive drum 1, is one pixel or more, and equal to or less than a predetermined number of pixels, the exposure amount control device 19 determines the pixels to be a thin-line portion. On the other hand, if the number of consecutive pixels having the same density data, in the both of the main scanning direction and the sub-scanning direction of the exposure device 17 on the photosensitive drum 1, exceeds the predetermined number of pixels, the exposure amount control device 19 determines the pixels to be a solid portion. Then, the exposure amount control device 19 controls the exposure amount of the thin-line portion to be smaller than that of the solid portion, in the image area having the same density data.

The predetermined number of pixels can be selected depending on the configuration of the image forming apparatus or desired image quality. For example, the predetermined number of pixels is, in a machine capable of rendering a pixel with 1200 dpi, desirably up to the order of 10 pixels because of latent image characteristics. When the predetermined number is 10 pixels, a change in a latent image electric potential is substantially saturated. A predetermined number of 1 pixel to 3 pixels is more desirable wherein a change in the latent image potential is less noticeable.

Now, the exposure amount control in the present exemplary embodiment will be described below in more detail. In the description below, monochrome image formation in black color will be described as a typical example of the exposure amount control according to the present exemplary embodiment. However, such an exposure amount control can also be applied to the image formation of each color in a full-color image forming apparatus such as the present exemplary embodiment.

Figure 7:
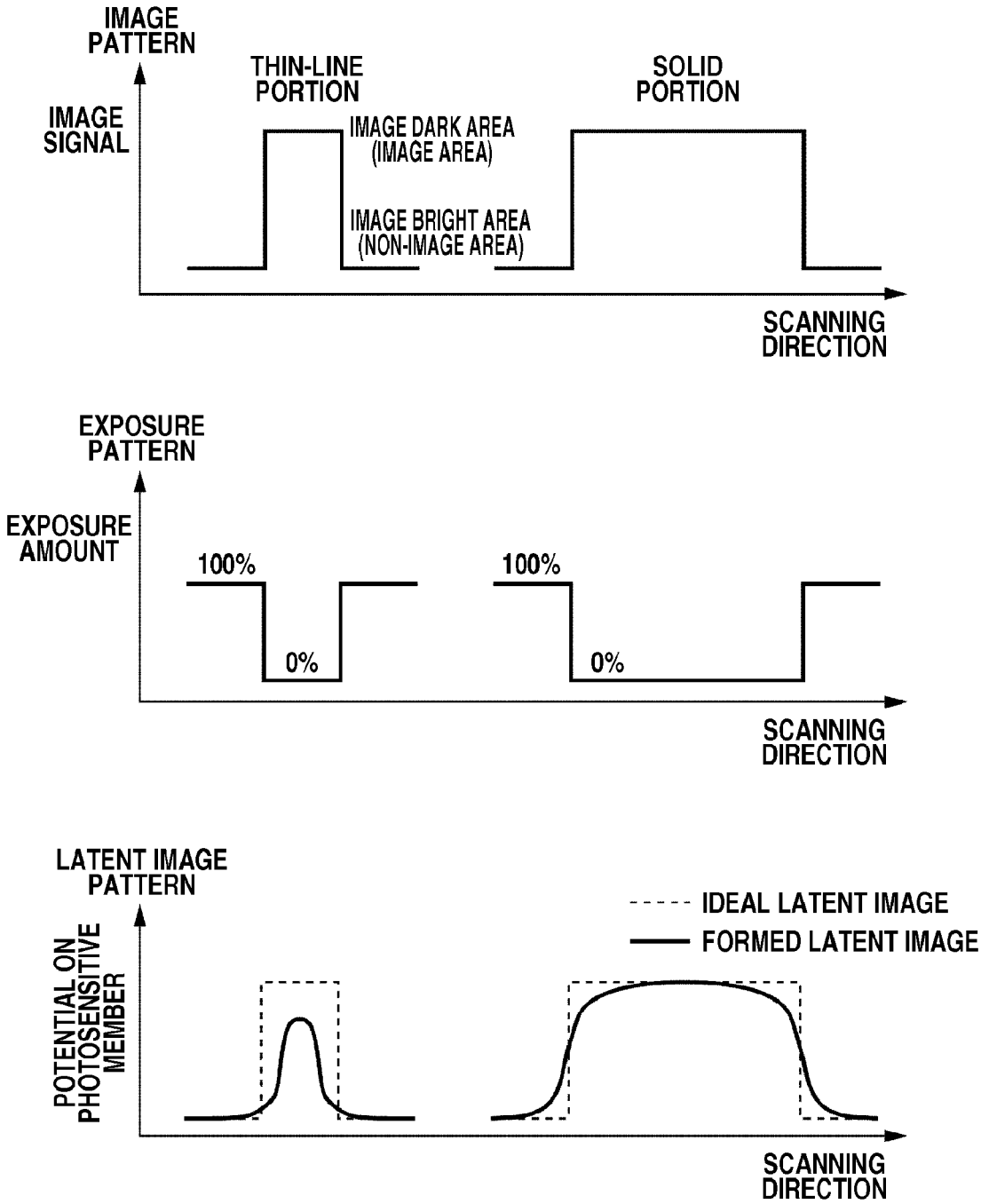
FIG.7 PRIOR ART
FIG. 7 is an explanatory view for illustrating relationships among an image signal, an exposure pattern (exposure amount) and a latent image pattern (electric potential on photosensitive member) in a thin-line portion and solid portion, in the conventional method.

First, referring to FIG. 7, the conventional method will be described where neither in a thin-line portion nor solid portion is corrected. An example illustrated in FIG. 7 is a case where a back area exposure method and a regular development method are employed.

In the conventional method, exposure is performed at a level of 100% only on the non-image area of image pattern, while exposure is not performed on the image area. As a result, it is presumed that the thin-line portion of a formed latent image has a lower electric potential in the photosensitive member 1 compared with a solid portion relative to the shape of an ideal latent image (dashed line).

Figure 8:
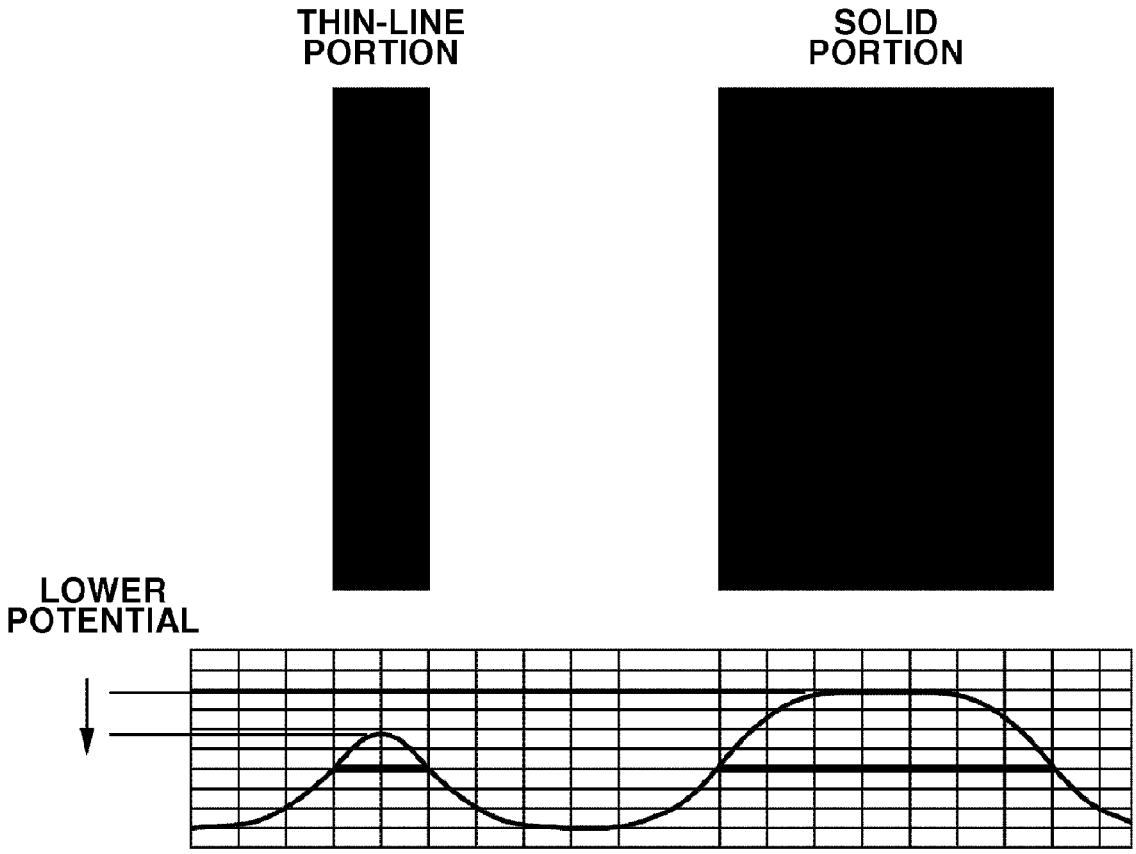
FIG.8 PRIOR ART
FIG. 8 is an explanatory view for illustrating the result of latent image simulation in a thin-line portion and solid portion, in the conventional method.

The result of the simulation is illustrated in FIG. 8. As its conditions, a charging potential of VD photosensitive member 1 is 400 V, and a developing potential Vdc is 200 V. Further, an exposure portion potential VL is 50 V in 100% quantity of light, image data resolution is 1200 dpi and a spot diameter is 55 μm. Then, it was assumed that the thin-line portion is a line of 2 pixels, and the solid portion is a line of 7 pixels. In addition, the characteristics of the photosensitive member 1 used in the study were entered as the photosensitive characteristics of the photosensitive member 1.

A charging potential VD is an electric potential of the surface of the photosensitive member 1 that has been subjected to a charging process by the charging device 2. A developing potential Vdc is a potential of DC component of developing bias to be applied to a developing sleeve 43. As an example, both the thin-line portion and the solid portion are a line extending along the sub-scanning direction, and the above numbers of pixels represent a number of pixels (i.e., width of line) in the main scanning direction.

Figure 5A:
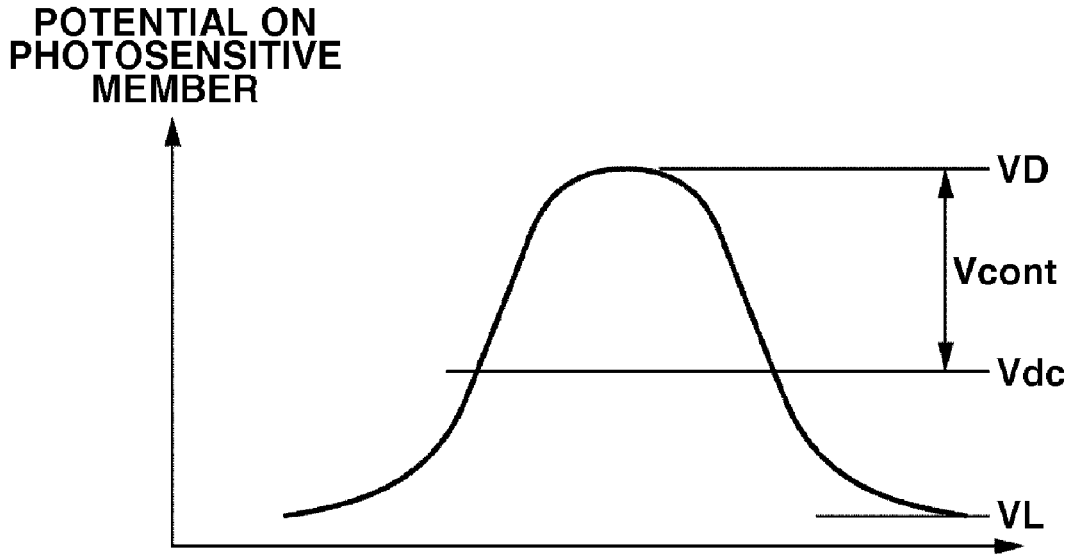
FIGS. 5A and 5B are graphic diagrams for describing the relationship between development contrast and amount of applied toner relative to development contrast.
Figure 5B:
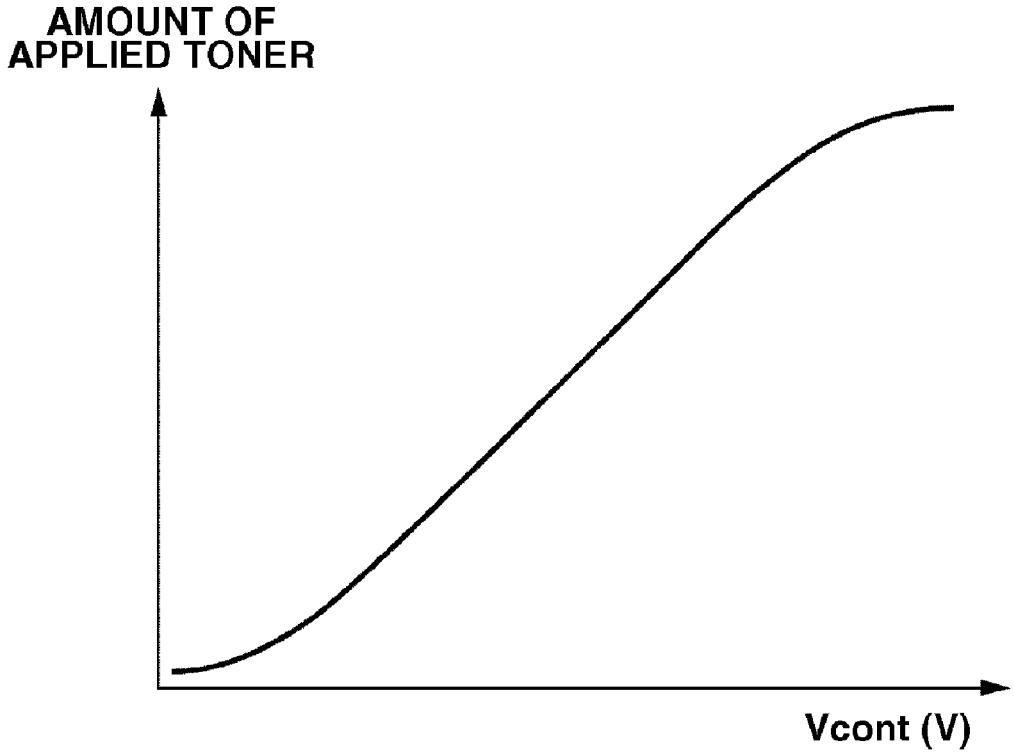

The amount of applied toner, as illustrated in FIG. 5B, depends on development contrast Vcont (=VD−Vdc: ideally 200 V in this example) illustrated in FIG. 5A. Therefore, since a charging potential VD in the thin-line portion becomes lower compared with the solid portion, a development contrast Vcont becomes smaller. As a result, the amount of applied toner to the thin-line becomes smaller, and thus reproducibility of the thin-line is deteriorated.

Next, correction of exposure amount by way of the exposure amount control according to the present exemplary embodiment to enhance reproducibility of the thin-line portion will be described.

First, the exposure amount control device 19 determines whether it is a thin-line portion or a solid portion by discriminating an image pattern using surrounding pixels around the focused pixel, pixels continuous from the focused pixel, or both.

In particular, in the present exemplary embodiment, an image area including consecutive three pixels or more (i.e. more than two pixels) in both the main scanning direction and the sub-scanning direction is determined to be a solid portion. On the other hand, in the case where the number of consecutive pixels of an image area in at least one of the main scanning direction and the sub-scanning direction is one or more but two or less, the image area is determined to be a thin-line portion. A numerical value or a method for determining an image pattern may be optimized as appropriate. For example, an image area may alternatively be determined to be a thin-line in the case where the number of consecutive pixels of the image area in at least one of the main scanning direction and the sub-scanning direction is one or more but some other predetermined number (other than two) or less. At least an image pattern portion discriminated to be a thin-line or an isolated dot consisting of at least one pixel is deemed as a thin-line portion.

Figure 2:
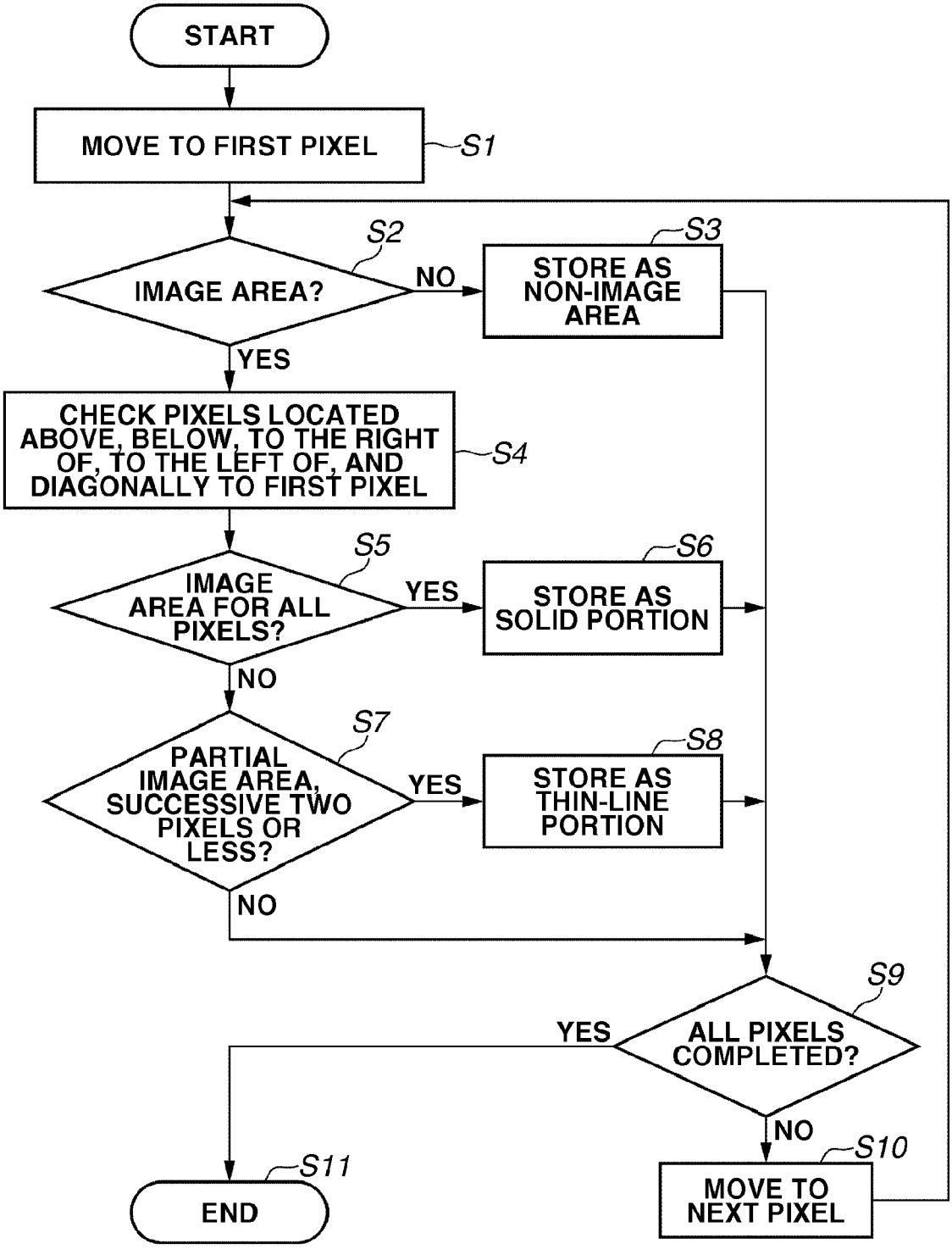
FIG. 2 is a flowchart of a method for discriminating an image pattern according to an exemplary embodiment of the present invention.

An example of a method for determining an image pattern will be more specifically described in accordance with a flowchart in FIG. 2. First, in step S1, the exposure amount control device 19 focuses on a first pixel of an image. In step S2, the exposure amount control device 19 determines whether the first pixel is representative of an image area or a non-image area.

If the first pixel is determined to be the non-image area (NO in step S2), then in step S3, the exposure amount control device 19 records that the first pixel is representative of the non-image area by adding the determination result to image data. If the first pixel is determined to be the image area (YES in step S2), then in step S4, the exposure amount control device 19 confirms whether pixels located above, below, to the right of, to the left of, and diagonally to the first pixel are representative of the image area or non-image area.

Then, in step S5, if all pixels belong to the image area (YES in step S5), then in step S6, the exposure amount control device 19 records that the image area is a solid portion by adding the confirmation result to the image data. If the image area is not a solid portion (NO in step S5), then in step S7, the exposure amount control device 19 determines whether the image area is a thin-line of two pixels or less by a pattern matching process. If it is a thin-line portion (YES in step S7), then in step S8, the exposure amount control device 19 stores the determination to the effect. If it is not a thin-line portion (No in step S7), the process advances to step S9. When steps S2 to S8 are completed, the exposure amount control device 19 moves to the next pixel to be focused, and repeats the steps (steps S9, S10, and S2 to S8) until all pixels are processed, and then ends in step S11.

Figure 3:
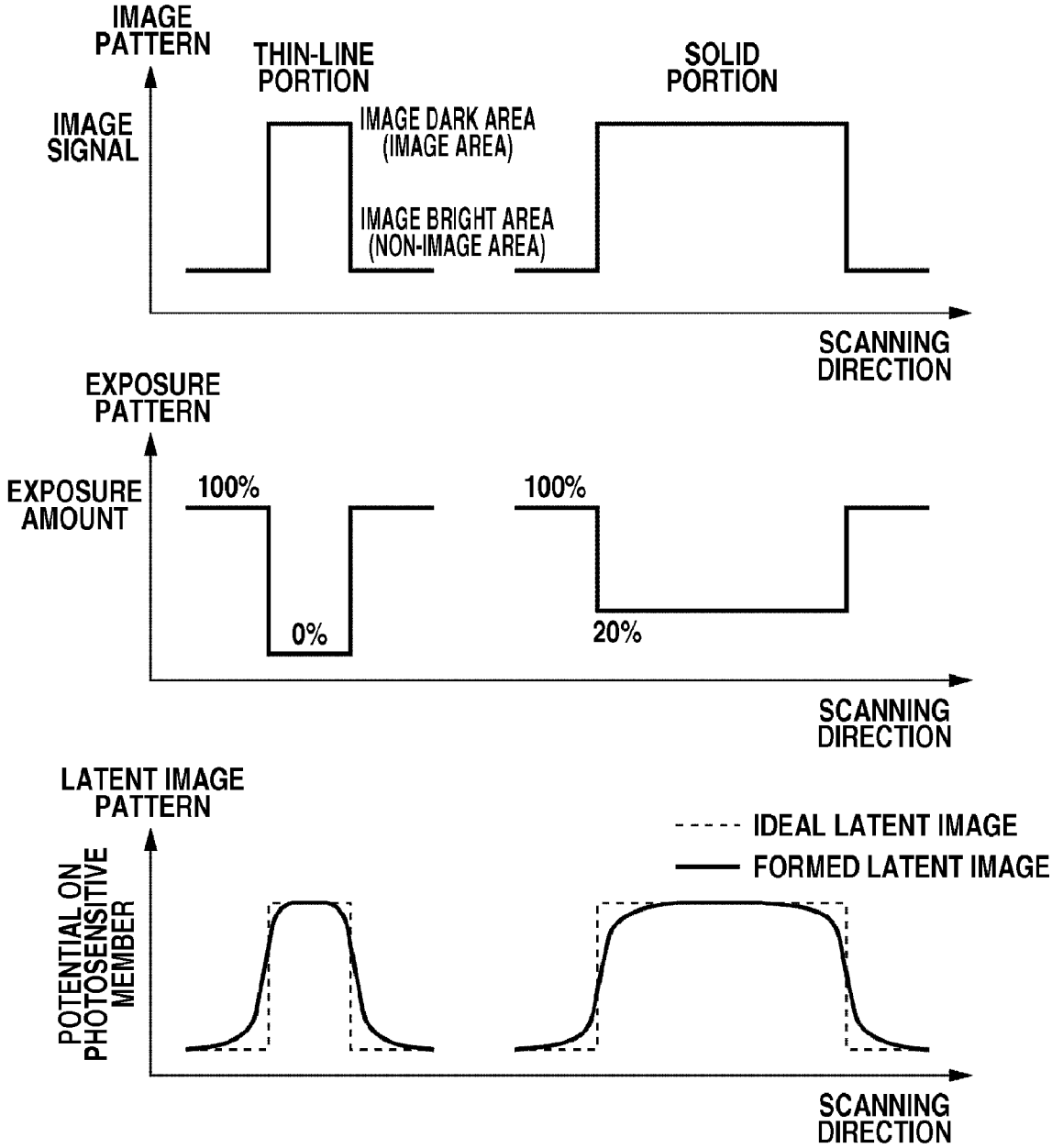
FIG. 3 is an explanatory view for illustrating the relationships among an image signal, an exposure pattern (exposure amount), a latent image pattern (electric potential on photosensitive member) and a result of latent image simulation in a thin-line portion and solid portion according to an exemplary embodiment of the present invention.
Figure 3:
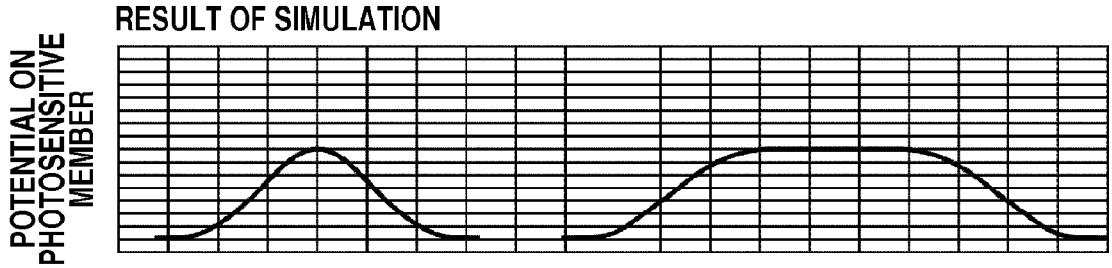

Then, as illustrated in FIG. 3, the non-image area is subjected to exposure in 100% quantity of light, where such 100% quantity of light can be, for example, like the 100% quantity of light of the conventional method. Further, exposure is not performed on the image area determined to be a thin-line portion (i.e., 0% quantity of light). On the other hand, exposure is performed on the image area determined to be a solid portion in 20% quantity of light.

A difference in the exposure amount between the thin-line portion and the solid portion, more specifically, a degree that the exposure amount of thin-line portion is to be made smaller than the solid portion (in other words, a degree that the exposure amount of the solid portion is to be made larger than the thin-line portion) can be selected as appropriate depending on configuration of the image forming apparatus, a desired image quality, or other factors. However, to obtain a practical effect, it is useful that the difference in the exposure amount is at least 10% or more. In other words, if the exposure amount of the thin-line portion is 0% quantity of light, it is useful that the exposure amount of the solid portion is 10% or more quantity of light.

Further, in the case where the correction according to the present exemplary embodiment is not conducted, thin-line reproducibility of one line of 600 dpi with respect to the same density signal value becomes about 50% at maximum in density compared with the solid portion. From this, it is useful that the difference in the exposure amount is further up to the order of 50% at maximum. Namely, if the exposure amount of the thin-line portion is 0%, then it is useful that the exposure amount of the solid portion is up to 50% quantity of light.

At that time, to secure in the solid portion the amount of applied toner similar to the conventional apparatus, a charging potential VD of the photosensitive member 1 is uniformly 450 V on the surface of photosensitive member 1 so that development contrast Vcont becomes 200 V. Other conditions of the simulation are similar to the simulation by the aforementioned conventional method. A result of the simulation is shown in FIG. 3. Namely, the development potential Vdc is 200 V.

Further, an exposure unit potential VL in 100% quantity of light is 50 V, image data resolution is 1200 dpi and a spot diameter is 55 μm. Then, the thin-line portion is made of a line of two pixels, and the solid portion is made of a line of seven pixels. Furthermore, characteristics of the photosensitive member 1 used in the study were entered as photosensitive characteristics of the photosensitive member 1.

As can be seen from the result of the simulation illustrated in FIG. 3, development contrast Vcont of the thin-line portion and the solid portion is maintained constant owing to the exposure amount control according to the present exemplary embodiment.

As above mentioned, a charging potential VD is boosted up to 450 V, and it is determined whether an image pattern is a thin-line portion or solid portion. Thus, an exposure amount of the image area is controlled by the exposure amount control device. As a consequence, development contrast Vcont of the thin-line portion is increased so as to enhance reproducibility of the thin-line. Further, by performing exposure on the solid portion in 20% quantity of light, the development contrast Vcont can be suppressed to a level similar to the one at a charging potential VD of 400 V. Accordingly, the reproducibility similar to the solid portion can be obtained in the thin-line portion.

Further, a problem that occurs in the method for reducing the spot diameter of the exposure device may not occur. In addition, since all that is needed is to add a device for discriminating an image, a manufacturing cost is lower compared with the cases where the spot diameter of exposure device is narrowed to make finer adjustment, or an automatic correction mechanism of focal points is provided. Further, since the development contrast Vcont in the solid portion is not higher than necessary, toner consumption becomes less compared with a method for enhancing thin-line reproducibility by increasing the charging potential VD of the photosensitive member. In addition, a phenomenon of flying toners does not become serious.

Next, another exemplary embodiment according to the present invention will be described. Since the basic configuration and operation of the image forming apparatus of the present exemplary embodiment are like those in the first exemplary embodiment, the same reference numerals are affixed to the elements having like functions or configurations as those in first exemplary embodiment, and redundant description is omitted.

In the present exemplary embodiment, reproducibility is further enhanced compared with the first exemplary embodiment by correcting exposure amounts of an edge portion and central portion of an image area determined to be a solid portion. Namely, in the present exemplary embodiment, an exposure amount control device 19 discriminates an image pattern, and varies an exposure amount depending on positions within the image area.

Figure 4:
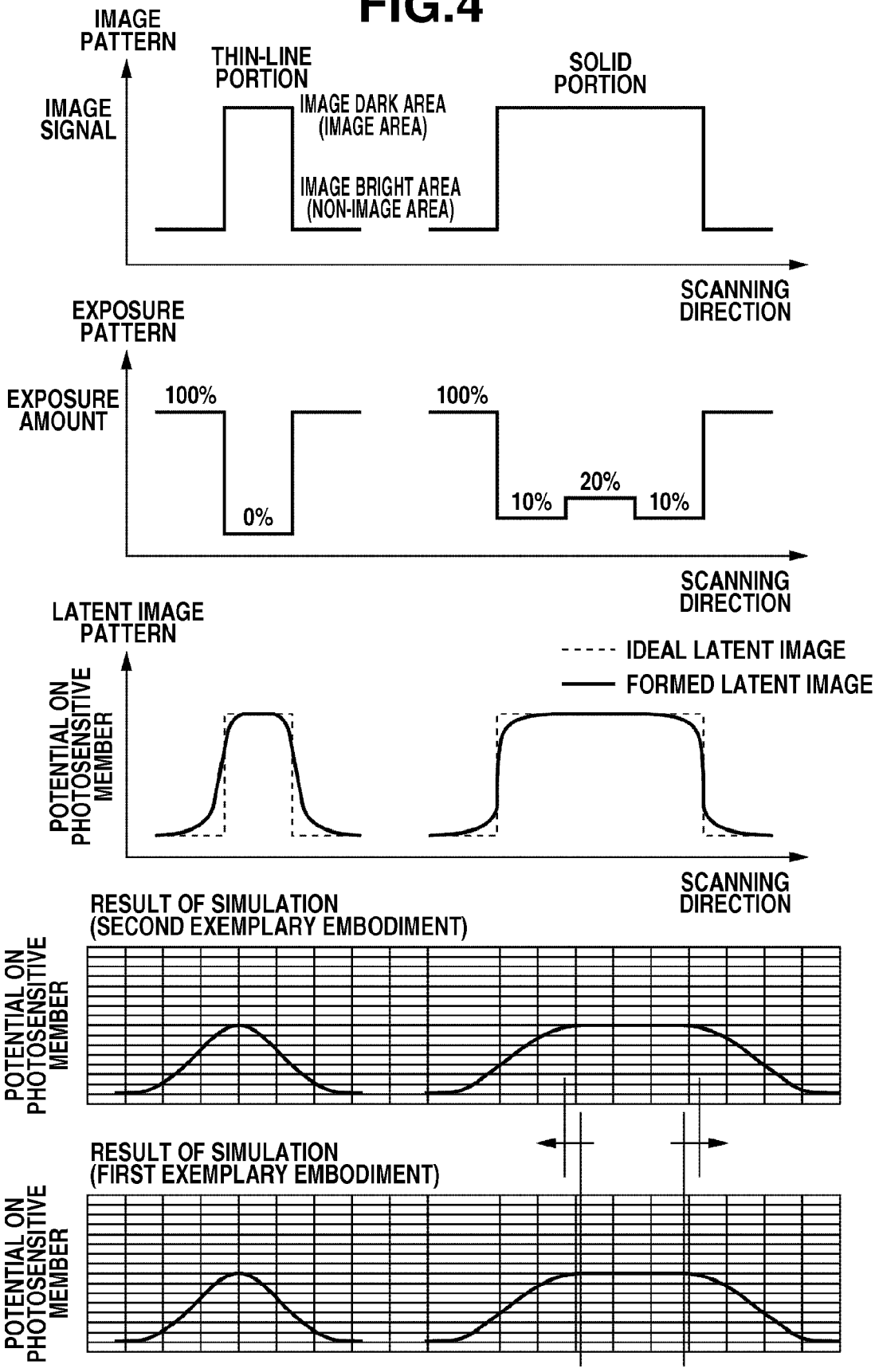
FIG. 4 is an explanatory view for illustrating the relationships among a image signal, an exposure pattern (exposure amount), a latent image pattern (electric potential on photosensitive member) and a result of latent image simulation in a thin-line portion and solid portion according to another exemplary embodiment of the present invention.

In particular, in the present exemplary embodiment, as illustrated in FIG. 4, a non-image area is subjected to exposure in 100% quantity of light, where such 100% quantity of light can be, for example, like the 100% quantity of light of the conventional method. In addition, exposure is not performed on an image area determined to be a thin-line portion (i.e., 0% quantity of light). On the other hand, exposure is performed in 20% quantity of light, in pixels of the central portion of the image area determined to be a solid portion from a discriminated image pattern, and exposure is performed in 10% quantity of light on pixels of an edge portion.

The difference in the exposure amount between the edge portion and the central portion, (in other words, in the present exemplary embodiment, a degree that the exposure amount of the edge portion is made smaller than the central portion) can be selected as appropriate depending on configuration of the image forming apparatus, desired image quality, or other factors.

Here, the edge portion of image area determined to be a solid portion is a predetermined number of pixels forming a border between a target image area and a non-image area outside the image area. The predetermined number of pixels (second predetermined number of pixels) forming the border can be selected as appropriate depending on configuration of the image forming apparatus, desired image quality, or other factors. However, if a border is too wide, an edge portion is highlighted, and accordingly, the number of pixels is desirably 1 pixel to 3 pixels, more desirably 2 pixels.

At that time, the same as the first exemplary embodiment, in order to secure the same amount of applied toner similar to the conventional method in the solid portion, the charging potential VD of the photosensitive member 1 was 450 V so that development contrast Vcont becomes 200 V.

The result of the simulation as illustrated in FIG. 4 will be compared with the first exemplary embodiment. The conditions of the simulation are similar to that of the first exemplary embodiment. As shown in FIG. 4, the width of the latent image of the solid portion is widened and reproducibility is improved by lowering the exposure amount of the edge portion, compared with the case of exposing the solid portion in 20% quantity of light across the board.

Figure 6A:
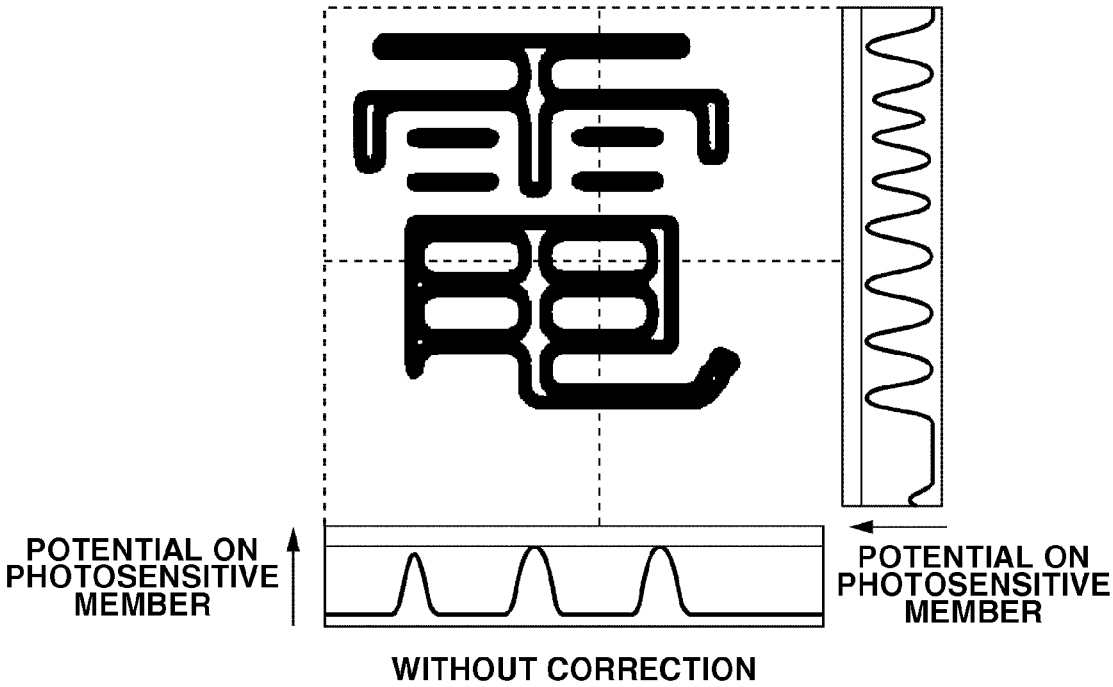
FIGS. 6A and 6B are simulation views illustrating character reproducibility according to an exemplary embodiment of the present invention.
Figure 6B:
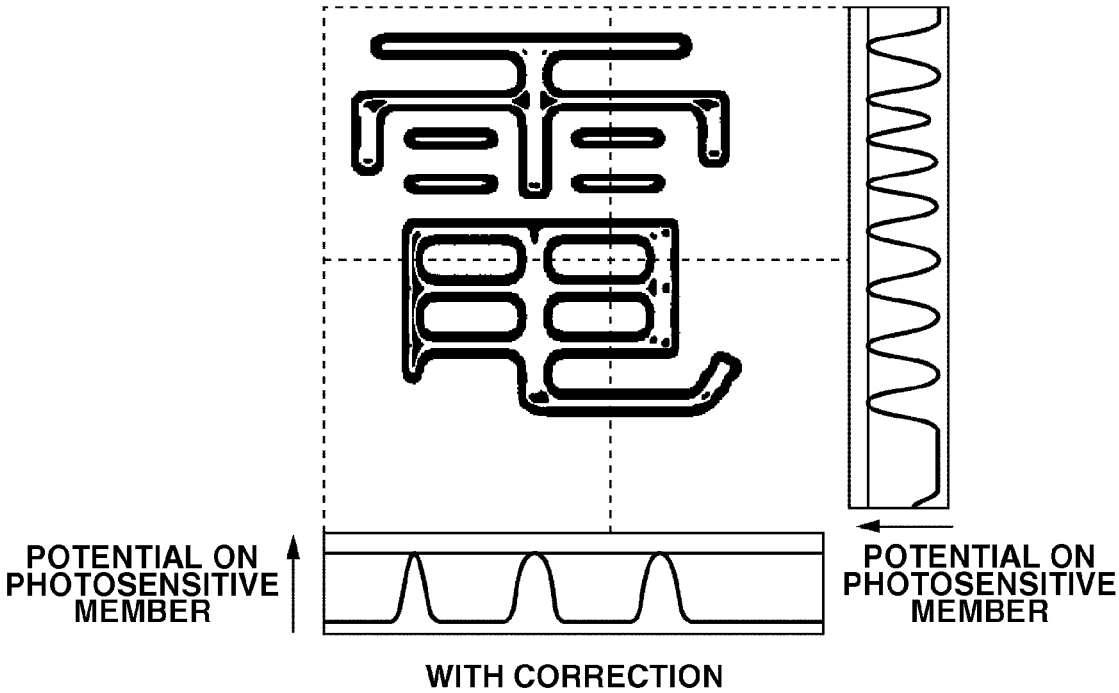

FIGS. 6A and 6B illustrate the result of the simulation of development contrast Vcont for a certain kanji-character in the cases where correction is performed as well as correction is not performed, in accordance with the present exemplary embodiment, respectively. In a portion representing kanji-characters in FIGS. 6A and 6B, the development contrast Vcont is smaller in a black portion than in a white portion. From FIGS. 6A and 6B, it is recognized that a constant development contrast Vcont is formed as a whole in the case where correction is performed, compared with the case of performing no correction. Further, electric potentials of the photosensitive member 1 in dashed lines crossing over kanji-characters in FIGS. 6A and 6B vertically (corresponding to a sub-scanning direction) and horizontally (corresponding to main scanning direction) are respectively shown in vertical and horizontal graphs in the drawings. From these graphs, it is also recognized that in the case of performing no correction, development contrast Vcont differs between the thin-line portion and the solid portion, whereas in the case of performing correction, development contrast Vcont is constant at any location As described above, the exposure amount control device discriminates whether the image pattern is the thin-line portion or the solid portion, and further, whether it is a central region or an edge region of the solid portion, then controls the exposure amount of the image area depending on the image pattern, so that high character reproducibility is obtained.

In the present exemplary embodiment, only the correction of exposure amount of the image area has been described, but the exposure amount of the non-image area of adjacent positions may also be corrected. To be more specific, the exposure amount of the non-image area adjacent to the image area is adjusted to be 120%. As a result, electric potential of the non-image area becomes locally low, and fly-off that is caused by a flying developer having an unstable electric charge can be suppressed, and reproducibility of the thin-line can be enhanced In addition, if a toner is applied on an edge portion, which is called an edge effect as a characteristic of development, an exposure amount of the edge portion may be increased to dull a latent image of the edge portion. To be more specific, the quantity of light in the edge is adjusted to be 30% as described referring to FIG. 4, while the quantity of light in the solid portion (central portion) remains 20%. Thus, it becomes possible to dull the latent image of the edge portion so as to suppress the edge effect of the development.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-321372 filed Dec. 12, 2007, which is hereby incorporated by reference herein in its entirety.

What is claimed is:

1. An image forming apparatus for forming a toner image on an image bearing member based on image data, the image forming apparatus comprising:

a charging unit configured to charge the image bearing member;

an exposure unit configured to form an electrostatic latent image on the image bearing member by exposing the image bearing member that has been charged;

a development unit configured to develop the electrostatic latent image with toner, wherein the development unit develops the electrostatic latent image into a toner image with density according to electric intensity generated between the development unit and the image bearing member;

a determination unit configured to determine whether the toner image formed on the image bearing member is a first image formed of an equal or smaller number of consecutive dots than a predetermined number in a predetermined direction or a second image formed of a larger number of consecutive dots than the predetermined number; and a control unit configured to control an exposure amount to expose the image bearing member by the exposure unit so that the electric intensity for forming the first image is higher than the electric intensity for forming the second image.

2. The image forming apparatus according to claim 1, wherein the toner image is formed on a portion of the image bearing member exposed by the exposure unit or a portion exposed with a light quantity smaller than a predetermined light quantity and is not formed on a portion exposed with a light quantity larger than the predetermined light quantity, and wherein the control unit controls the exposure unit so that the exposure amount for forming the first image is smaller than the exposure amount for forming the second image in order that the electric intensity for forming the first image is higher than the electric intensity for forming the second image.

3. The image forming apparatus according to claim 1, wherein the image bearing member is movable to a position where a surface of the image bearing member is exposed, wherein the exposure unit exposes the image bearing member in a moving direction of the surface of the image bearing member and a direction orthogonal to the moving direction, and wherein the predetermined direction is at least one of the moving direction and the direction orthogonal to the moving direction.

4. The image forming apparatus according to claim 1, wherein the determination unit, with respect to the second image, differentiates an edge portion that is a border between the second image and an area outside the second image where the toner image is not formed and a central portion surrounded by the edge portion, and wherein the control unit controls the exposure unit based on a differentiation result by the determination unit so that an exposure amount for forming the edge portion is smaller than an exposure amount for forming the central portion.

* * * * *